US006242853B1

(12) United States Patent
Mulholland

(10) Patent No.: US 6,242,853 B1
(45) Date of Patent: Jun. 5, 2001

(54) LAMP HOLDER FOR LOW-WATTAGE-LIGHTING SYSTEMS

(75) Inventor: Robert Mulholland, Hengelo (NL)

(73) Assignee: Stichting Kennisbeheer Nederland, Ze Hengelo (NL)

( * ) Notice: Subject to any disclaimer, the term of this patent is extended or adjusted under 35 U.S.C. 154(b) by 0 days.

(21) Appl. No.: 09/194,095

(22) PCT Filed: May 20, 1997

(86) PCT No.: PCT/NL97/00287

§ 371 Date: Jun. 24, 1999

§ 102(e) Date: Jun. 24, 1999

(87) PCT Pub. No.: WO97/44868

PCT Pub. Date: Nov. 27, 1997

(51) Int. Cl.[7] ..... H01J 5/48

(52) U.S. Cl. ..... 313/318.01; 313/318.09; 313/318.1

(58) Field of Search ..... 313/318.01–318.12; 362/374, 375, 262, 263, 275; 439/611, 619, 356, 226, 375, 220, 232, 227

(56) References Cited

U.S. PATENT DOCUMENTS 2,101,277 12/1937 Wappler ..... 176/32
5,676,454 * 10/1997 De'Armond Jr. ..... 362/275

FOREIGN PATENT DOCUMENTS 8710787 1/1988 (GB) ..... H01R/33/05
4310440 2/1994 (GB) ..... H01R/25/16

* cited by examiner

*Primary Examiner*—Nimeshkumar D. Patel
*Assistant Examiner*—Joseph Williams
(74) *Attorney, Agent, or Firm*—Hayes, Soloway, Hennessey, Grossman & Hage, P.C.

(57) ABSTRACT

A lamp holding has a first conductor forming an exterior surface of the lamp holding, the first conductor having a first opening formed therein to slidably receive a first lead of a lamp and a second conductor having a second opening formed therein to slidably receive a second lead of the lamp.

12 Claims, 2 Drawing Sheets

LAMP HOLDER FOR LOW-WATTAGE-LIGHTING SYSTEMS

Figure 1:
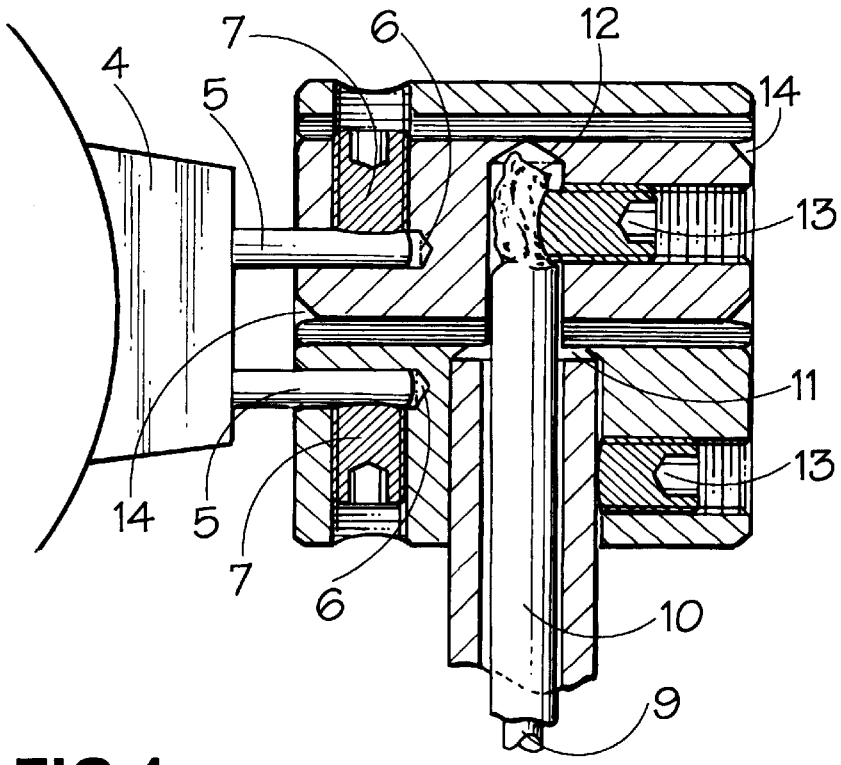

The present invention relates to the field of—mainly low-voltage—lighting systems, and in particular to the manner in which a lamp is attached to a luminaire.

The means with which a lamp is conductively fitted in a luminaire is ordinarily termed a lamp holder. The construction of such a lamp holder depends on the fitting means that are provided on a lamp for that purpose. In any case, there must be two electric conductors which are separately fixed in the lamp holder.

Usually, the body of the lamp holder is formed by the insulator. In addition, the lamp holder must contain fitting means to permit the lamp to be fitted in the lamp holder, so that the electric conductors of the lamp contact the electric conductors of the lamp holder. Examples of means by which lamps are fixed are an edison screw, a bayonet cap and a pinandsocket connection, locked with a spring or a screw, such as the generally available ceramic lamp holders with so-called GX 5.3 bases.

The problem with these commercially available lamp holders is that they, in their turn, must be fitted in the luminaire, and that for the power supply from the luminaire they offer no alternative but copper wire or an other conductor of similar diameter. With specially produced lamp holders this problem is solved by integrating the lamp holder with the luminaire as an external part thereof.

Advantages of such special lamp holders are that they permit the power supply to the lamp not to run in the same direction (for instance, perpendicular to the path of the current in the lamp), and that they can be made of the same material as the luminaire, which facilitates finishing treatments, such as surface treatments, as for instance coloration. However, a problem with such lamp holders is the separation of the two live parts of the lamp holders. In fact, this should be done in such a manner that a number of international standards are complied with (see for instance IEC 598). It is the required heat resistance, in particular, which presents problems, because the insulator that is usually placed between the conducting parts mostly also serves for fixing the two parts together, in which case the insulator and the conducting parts must have identical coefficients of expansion to prevent them falling apart. This aspect is also of importance when the luminaire is coloured by means of powder coating (in which heating is involved), which neutralizes the above-mentioned advantage (the same material).

The present invention solves these problems by providing one conductor of the lamp holder enclosed in the other, so that all the above-mentioned advantages are retained.

Advantages of the invention are the following:

- Fixing the two conducting parts together can be done without making use of fixing and/or locking materials;
- The lamp holder does not present problems connected with the coefficient of expansion of the insulator being different from that of the other material of the lamp holder;
- The lamp holder can be made of the same material as the luminaire;
- The lamp holder itself can form an external part of the luminaire;
- The lamp holder permits the lamp to be fitted perpendicular to the luminaire; instead of in line with it;
- Production of the lamp holder is simple, as it has only three main parts, and these are also the conductors;
- The lamp holder can be used for luminaires of which the body itself is one of the conductors, and can be rotatably fixed on such luminaires;

- The lamp holder permits all the conductors to be firmly connected, which is very important for low-voltage systems;
- The lamp holder complies with the international legal requirements in this area (SELV), inter alia with those governing the distance between conductors, whilst the insulator can still be thinner than that distance, because the two parts of the lamp holder have bevelled edges and need not be insulated from each other but through the insulator and the distance provided by the bevelled edge.

Figure 2:
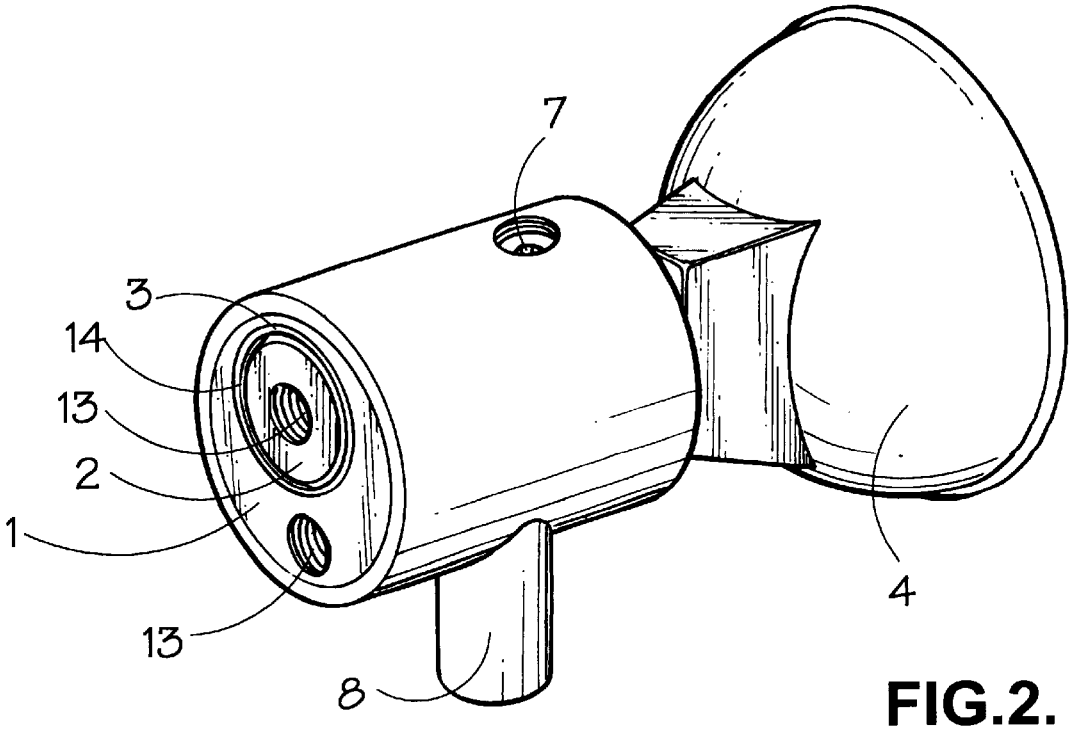
Figure 3:
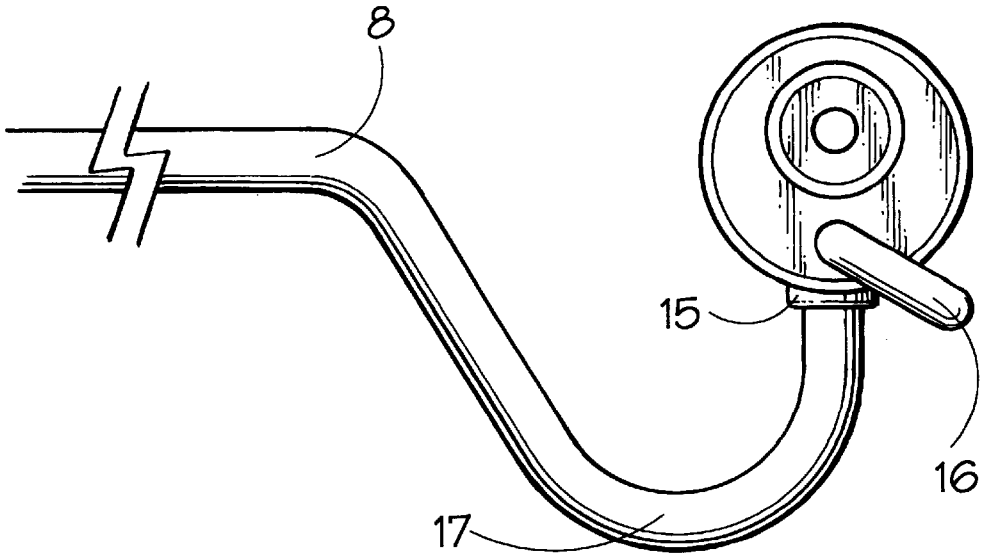
Figure 4:
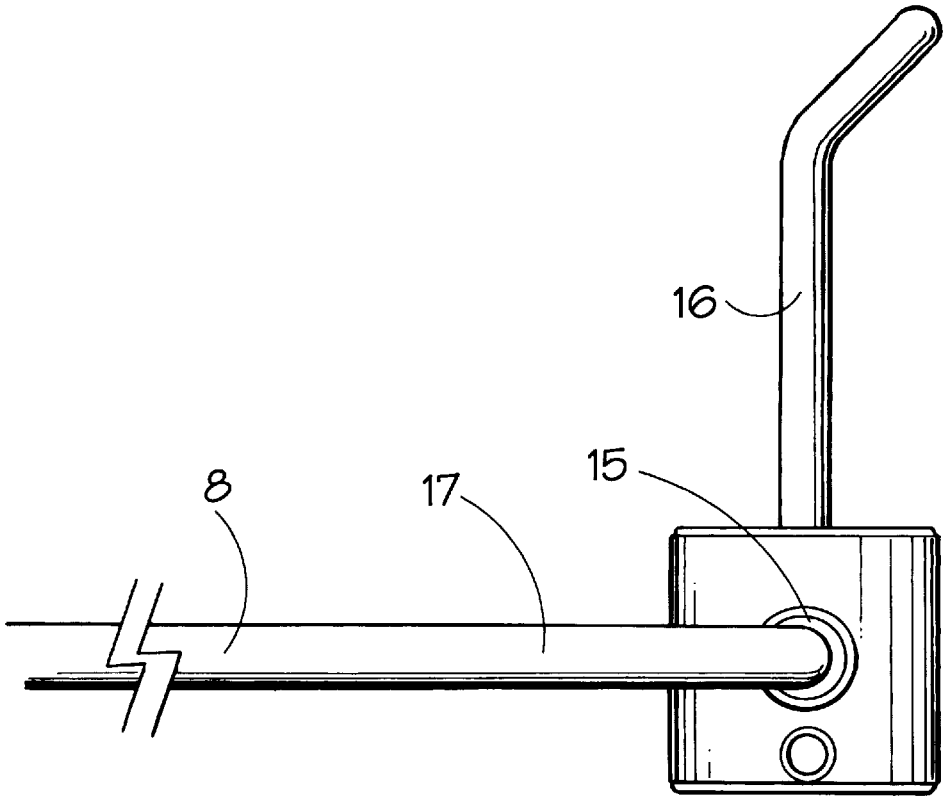

A description will now be given of an embodiment of the present invention for a low-voltage (halogen) lamp with a bi-pin base (for instance, type GX 5.3) which is to be fitted at right angles to the luminaire. FIG. 1 shows the lamp holder described in section and FIG. 2 in perspective. The FIGS. 3 and 4 are a plan view and a side view of a possible application of the lamp holder described in combination with a luminaire of special shape.

The lamp holder consists of two conductors (1, 2) and an insulator (3), and for fixing one to the other there is no need to use any fixation and/or locking materials, because one conductor (2) is smaller than the other (1) and fits entirely and very tightly in the insulator (3), which fully encloses the conductor (2) and fits entirely and very tightly in the other conductor (1), which fury encloses the insulator (3), in such a way that the two ends of all three components coincide precisely, without any of them projecting more than the other two. To minimize the dimensions, the ends of the hole in the conductor (1) can be provided with a bevelled edge (14), as a result of which the distance between the end of the insulator (3) and the end of the conductor (1) is equal to the thickness of the insulator, so that the legal requirements with regard to the distance between the two conductors is complied with, whereas the insulator can be thinner than that distance, and yet the two conductors (1, 2) need not be insulated from each other in some other way.

For the conducting fixation of the conducting lamp pins (5) of the lamp (4) the lamp holder has certain provisions, which here have the form of a socket (6) in each conductor (1, 2) of the lamp holder. The lamp pins (5) are locked in the sockets (6) with the aid of screws for which provisions have been made in the lamp holder (7). The presence of the locking screws ensures a secure and conducting accommodation of the lamp (4) in the lamp holder. The length of the screws used is determined by the thickness of the small conductor (2): the screw must not connect up with the other conductor (1) and must have sufficient material in the small conductor (2) to be securely fixed.

The lamp holder is attached to a luminaire, of which the body (8) is one of the conductors. The other conductor (9) of the luminaire passes throught the body (8) and is separated therefrom by an insulation (10), for instance copper wire with an insulating sheath. In the present case the lamp holder has been mounted perpendicular to the luminaire. To this end the two conducting parts of the lamp holder (1 and 2) are provided with an opening (11 and 12, respectively) to accommodate the conductors of the luminaire (8 and 9, respectively). For the same reasons, both of them are locked in position with the aid of, for instance, screws, for which provisions (13) have been made in the holder. The live connection between the small conductor (2) and the wire (9) is effected by the screw (13), which locks the wire (9) by turning it through the insulation (10).

Attachment and locking of the lamp holder on the luminaire is effected by means of the attachment and locking means used for the live connection (13 on 8 and possibly 13 on 9). To ensure the good conductive contacts that are so important in this type of lighting it is advisable to make the fits as tight as is practically possible, which also applies, where necessary, to all the other attachments, so that firm contacts are ensured. Of course, this is also true of any other means of attachment.

If the lamp is to be placed in line with the luminaire, the fitting openings (11, 12) and their means of attachment (13) change places, and the small conductor (2) of the lamp holder and the insulator (3) need not extend through the entire length of the large conductor (1), but only, for instance, to a point halfway.

If it is desired to keep the dimensions of the entire lamp holder as small as possible, then the small conductor (2) is probably best mounted excentrally in the large conductor (1). Further alternatives can, of course, be found in the shape (six-angled, square, etc.), means of attachment (for instance, everything fastened with screws), the exact location of the possibly present bevelled edge (on both halves of the holder or on one of the two, or on neither, or on only one of the ends of the lamp holder), the way in which the large conductor encloses the small one (entirely, one of them projecting from the other, the small conductor being enclosed only partially in the large one, etc.) etc.

When the locking mechanism (13) of the lamp holder on the body (8) is extended to a point outside the holder, there is obtained a positioning rod (16), which can be manipulated with the fingers and repeatedly locked, and with which the locking can be temporarily removed, so that the holder can be turned round the body (8), provided that the fit of the holder on the body (8) permits this. For this lastmentioned purpose use can be made of a cylindrical holder clamp (15), which is clamped round the end of the body and fits tightly in the holder. It is provided with a groove round its exterior surface at the locking means (13 or 15), and also serves as an extra lock when the holder is turned, because the locking remains within the groove when the lock is partially removed, and it is impossible for the holder to come off the body (8).

If the body (8) is bent at a point (17) just before the lamp holder, the holder can be fastened in line with the body and still have a point of attachment which is perpendicular to the main direction of the body (8). In addition to having an aesthetic advantage, this shape ensures that the luminaire—for instance, when used horizontally—is suspended in equilibrium when the shape of the body is a downwardly bent one (for instance, the holder is to be positioned lower than the point of attachment of the entire luminaire): since the holder extends in line with the body (8), the luminaire will not sag under the influence of gravity, as happens with a horizontal attachment without bend (17), in which case the luminaire may sag down on the side where the lamp holder is attached.

The bend (17), in cooperation with the positioning rod (16) also prevents the holder from getting turned round further and further (for in that case the wire in the luminaire might break): when the positioning rod (16) is turned round, it hits the body (8) and is blocked in its way, so that the holder can turn through an angle of just under 3600.

What is claimed is:

1. A lamp holder for securing a lamp, comprising:

a first conductor forming an exterior surface of said lamp holder, the first conductor having a first opening formed therein to slidably receive a first lead of said lamp; and a second conductor having a second opening formed therein to slidably receive a second lead of said lamp.

2. The lamp holder of claim 1, further comprising a first connector and a second connector to forcibly couple the first lead to the first conductor and the second lead to the second conductor.

3. The lamp holder of claim 2, wherein the first connector comprises a locking screw.

4. The lamp holder of claim 2, further comprising a fourth opening and a fifth opening in the first conductor to allow access to the first connector and the second connector.

5. The lamp holder of claim 1, further comprising a third opening in the first conductor to allow the lamp holder to be coupled to a hollow structure.

6. The lamp holder of claim 5 further comprising a third connector to forcibly couple the lamp holder to the hollow structure.

7. The lamp holder of claim 5, further comprising a locking handle to selectively couple and decouple the lamp holder to the hollow structure.

8. The lamp holder of claim 5, further comprising an insulated conductor extending through the hollow portion of the hollow structure and coupled to the second conductor.

9. The lamp holder of claim 1, further comprising an insulator to insulate the first conductor from the second conductor.

10. The lamp holder of claim 1, wherein the first conductor is cylindrical.

11. The lamp holder of claim 10, wherein the second conductor is eccentrically located within first conductor.

12. The lamp holder of claim 1, wherein then first lead and the second lead form an interference fit in the first opening and the second opening.

* * * * *